US010450791B2

(12) United States Patent
Kuster et al.

(10) Patent No.: US 10,450,791 B2
(45) Date of Patent: Oct. 22, 2019

(54) CORNER ASSEMBLY FOR INSULATED GLASS ELEMENTS HAVING FILMS ADHESIVELY JOINED IN AN EDGE-FLUSH MANNER

(71) Applicant: SAINT-GOBAIN GLASS FRANCE, Courbevoie (FR)

(72) Inventors: Hans-Werner Kuster, Aachen (DE); Walter Schreiber, Aachen (DE); Francis Serruys, Bruges (BE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 16/089,328

(22) PCT Filed: Jul. 4, 2017

(86) PCT No.: PCT/EP2017/066605
§ 371 (c)(1),
(2) Date: Sep. 27, 2018

(87) PCT Pub. No.: WO2018/028885
PCT Pub. Date: Feb. 15, 2018

(65) Prior Publication Data

US 2019/0106930 A1 Apr. 11, 2019

(30) Foreign Application Priority Data

Aug. 11, 2016 (EP) ..... 16183774

(51) Int. Cl.
*E06B 3/62* (2006.01)
*E06B 3/66* (2006.01)
(Continued)

(52) U.S. Cl.
CPC ..... *E06B 3/6202* (2013.01); *E06B 3/56* (2013.01); *E06B 3/6612* (2013.01);
(Continued)

(58) Field of Classification Search
CPC ..... E06B 3/6202; E06B 3/673; E06B 3/6612; E06B 3/66366; E06B 3/56; E06B 3/6617; E06B 1/363
See application file for complete search history.

(56) References Cited

U.S. PATENT DOCUMENTS

2012/0141699 A1* 6/2012 Mader ..... E06B 3/66366 428/34

FOREIGN PATENT DOCUMENTS

DE 3520973 A1 12/1986
EP 1811114 A2 7/2007

OTHER PUBLICATIONS

Written Opinion for International Application No. PCT/EP2017/066605 filed Jul. 4, 2017 on behalf of Saint-Gobain Glass France. dated Jul. 28, 2017. 9 pages (English Translation + German Original).

(Continued)

*Primary Examiner* — Patrick J Maestri
(74) *Attorney, Agent, or Firm* — Steinfl + Bruno LLP

(57) ABSTRACT

A corner assembly including two insulated glass elements is presented. The two insulated glass elements are abutted against each other at an angle. Each of the two insulated glass elements include at least two panes. According to one aspect, the at least two panes are joined to each other using a spacer profile under formation of an interpane space. According to another aspect, the at least two panes are arranged parallel to each other. In yet another aspect, the at least two panes have, on their end region, mitered abutment ends, the mitered abutment ends being joined to each other via a film. The film is provided for joining the insulated glass elements using an adhesive means.

16 Claims, 4 Drawing Sheets

Figure 1:
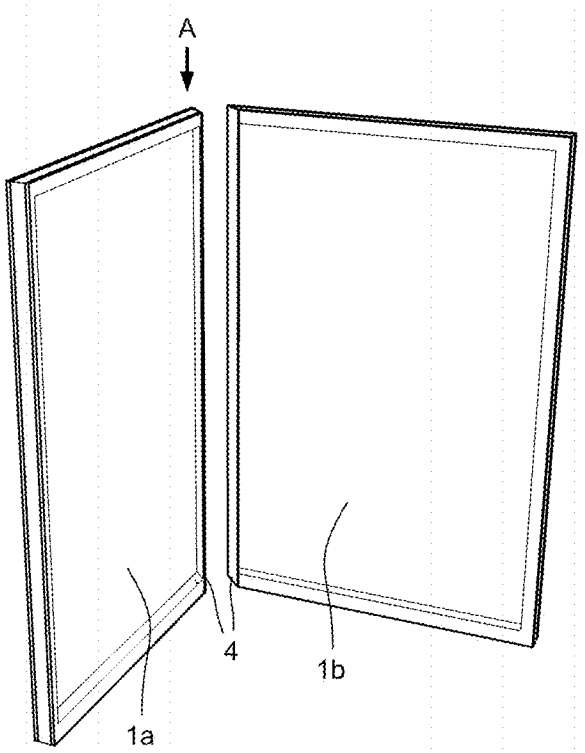

(51) Int. Cl.

| | |
|---|---|
| ***E06B 3/56*** | (2006.01) |
| ***E06B 3/663*** | (2006.01) |
| ***E06B 3/673*** | (2006.01) |

(52) U.S. Cl.
CPC ..... *E06B 3/6617* (2013.01); *E06B 3/66366* (2013.01); *E06B 3/673* (2013.01); *E06B 2003/6291* (2013.01)

(56) References Cited

OTHER PUBLICATIONS

International Search Report for International application PCT/EP2017/066605 filed Jul. 4, 2017 on behalf of Saint-Gobain Glass France. dated Jul. 28, 2017. 5 pages.

* cited by examiner

CORNER ASSEMBLY FOR INSULATED GLASS ELEMENTS HAVING FILMS ADHESIVELY JOINED IN AN EDGE-FLUSH MANNER

CROSS REFERENCE TO RELATED APPLICATIONS

The present application is the U.S. National Stage of International Patent Application No. PCT/EP2017/066605 filed on Jul. 4, 2017, which, in turn, claims priority to European Patent Application No. 16183774.5 filed on Aug. 11, 2016.

The invention relates to a corner assembly for insulated glass elements, an insulated glass element, and use of the corner assembly in an all-glass façade.

Corner assemblies for insulated glass elements are increasingly frequently installed with glass façades on buildings for aesthetic reasons, in particular with façade transitions or when the façade is executed optically as an all-glass façade. The abutting insulated glass elements are held framelessly in the corner region in order to satisfy the optical demands.

Such insulated glass elements are made of at least two panes that are held at a distance from each other by a spacer. The panes can have a coating, in particular a heat and/or solar protection coating. In known embodiments of insulated glass elements for all-glass façades, stepped glasses are customarily used. Stepped glasses are distinguished by the fact that the on-site outer pane is larger than the inner pane. Thus, in the case of a corner assembly, a cavity develops in the abuttment region of the insulated glass elements, which cavity is usually sealed with a sealing material in its joint region.

EP 1 811 114 A2 discloses an all-glass corner made of insulating glass, which has two insulating glass parts butting against each other at an angle. The insulating glass parts butt against each other such that they form a continuous gas-filled interpane space in the region of their abutment ends. The glass panes of the insulating glass parts are mitered on their abutment ends. The abutment surfaces of the glass panes are provided in each case with a step such that the abutment ends of the abutting glass panes form a rebated joint that is widened toward the interpane space. The abutment surfaces of two abutting glass panes are in each case joined together using a double-sided adhesive strip. A particular difficulty consists in manufacturing the all-glass corners since the mechanical load of the connection is very high and transport of the all-glass corners from the manufacturing site to the installation site requires special, expensive safety measures. However, all-glass corners produced in this manner are not very stable, posing significant problems, particularly in manufacturing and in transport.

The object of the invention is to provide a corner assembly of two insulated glass elements abutting at an angle, wherein the mechanical load capacity is increased.

The object of the present invention is accomplished by a corner assembly in accordance with the present disclosure. Preferred embodiments are also disclosed.

The corner assembly according to the invention includes two insulated glass elements abutting at an angle, which have in each case at least two panes that are joined to each other using a spacer profile under formation of an interpane space. According to the invention, the parallel arranged panes have, on their end regions, mitered abutment ends that are joined to each other via a film, wherein the film of the insulated glass elements has adhesive means, via which the insulated glass elements are adhesively joined to each other.

Advantageously, the insulated glass elements have on their abutment ends a film; they can, as a result, even be transported individually and adhesively joined to form a corner assembly only at the site of use. Thus, the complexity of transport of the corner assembly from the manufacturing site to the site of use is significantly simplified. By adhesively joining the insulated glass elements at the site of use, the effort in the manufacture of the corner assembly is advantageously optimized.

The panes of the insulated glass elements are, in particular, insulating glass panes, composite panes, or single glass panes. A composite pane can include at least two panes that are joined to each other via an intermediate layer. The intermediate layer can advantageously be a thermoplastic material, such as polyvinyl butyral (PVB), ethylene vinyl acetate (EVA), polyurethane (PU), polyethylene terephthalate (PET), or multiple layers thereof, preferably with thicknesses from 0.3 mm to 0.9 mm.

In an advantageous embodiment of the corner assembly according to the invention, the panes can be made of flat glass, float glass, soda lime glass, quartz glass, or borosilicate glass. The thickness of each pane can vary and must thus be adapted to the requirements of the individual case. Preferably, panes with standard thicknesses from 2.00 mm to 25 mm and, preferably, from 3 mm to 19 mm, are used.

The size of the pane can vary widely and is governed by the size of the use according to the invention. Additionally, to increase the insulating effect, coatings, preferably transparent, that further reduce the emissivity can be applied to the surfaces of the panes.

The panes can be colorless or colored and/or have a coating, in particular, a transparent and/or electrically conductive coating.

The transparent, electrically conductive coating according to the invention can be permeable to electromagnetic radiation, preferably electromagnetic radiation of a wavelength from 300 to 1300 nm, in particular for visible light from 390 nm to 780 nm. "Permeable" means that the total transmittance of the pane is, in particular for visible light, preferably >70% and in particular >75%.

The transparent, electrically conductive coating is preferably a functional coating, particularly preferably a functional coating with solar protection. A coating with solar protection has reflecting properties in the infrared range and, thus, in the range of sunlight. By this means, heating of the interior of the building as a result of sunlight is advantageously reduced.

Such coatings are known to the person skilled in the art and typically include at least one metal, in particular silver or a silver-containing alloy. The transparent, electrically conductive coating can include a sequence of multiple individual layers, in particular at least one metallic layer and dielectric layers that contain, for example, at least one metal oxide. The metal oxide preferably contains zinc oxide, tin oxide, indium oxide, titanium oxide, silicon oxide, aluminum oxide, or the like, as well as combinations of one or more thereof. The dielectric material can also contain silicon nitride, silicon carbide, or aluminum nitride.

The panes are joined to each other via a spacer profile. The spacer profile is situated between the panes and is preferably attached by gluing between the spacer profile and the pane. Usable as the main body of the spacer profile are all hollow body profiles known from the prior art regardless of their material composition, such as glass, polymers, or metals (e.g., stainless steel or aluminum). The spacer profile is preferably frame-like and sealed against gas diffusion. For this, the spacer profile is bonded to the panes using a primary sealant, such as polyisobutylene, and the edge joint is filled with a secondary sealant, such as polysulfide. The two spacer profiles of the insulated glass elements butt against each other at the abutment ends of the insulated glass elements. For this, the abutment ends of the spacer profiles also have a miter. The interpane space can be filled with air or a gas, in particular a noble gas, argon or krypton.

In an advantageous improvement of the corner assembly according to the invention, the film is arranged in an edge-flush manner. The width of the film is adapted to the total thickness of an insulated glass element and can correspond substantially to the width of the mitered abutment ends plus the width of the interpane space of an insulated glass element, with the width of the interpane space corresponding to the distance between the panes.

The width of the film can increase to a multiple if the insulated glass element comprises multiple spaced panes and multiple interpane spaces. Advantageously, for determination of the width of the film, only the total thickness of the insulated glass element is of significance and not the distance between the panes. The distance between the panes can vary in a multipane glazing. As a rule, knowing the total thickness of the insulated glass element suffices to determine the width of the film, regardless of the number of panes of the insulated glass element or the width of the individual interpane spaces.

In another advantageous improvement, the film is provided to gas-tightly seal the interpane space of the insulated glass element. The film can be rigid or flexible and/or can have a thickness of 0.001 mm to 1 mm, in particular 0.3 mm.

The film adheres to the end regions of the panes and of the spacer by means of an adhesive, in particular an acrylate adhesive. Advantageously, the adhesive is, for this purpose, applied to the miter planes of the panes and the film is pressed onto the miter planes of the pane.

In another advantageous improvement of the corner assembly according to the invention, the film can contain a plastic, in particular a polypropylene. Such plastic films are frequently made of polyolefins, such as polyethylene (PE) with high and low density, or polypropylene (PP), PET.

Alternatively, the film can be made of glass, in particular of paper-thin glass. The film made of glass increases the optical transparency of the corner assembly according to the invention. The thickness of the glass film can be from 0.3 mm to 3 mm, preferably 0.5 mm.

Alternatively, or additionally, the film can be gas- and/or vapor-diffusion-tight. The film can have a coating, in particular an SiOx coating and/or a metallic coating. The gas-tightness of the film is substantially improved by the SiOx coating. In addition to this action as a sealing material, the coating can be applied to the film for a purely decorative purpose, in particular to a surface of the film facing the interpane space. In order to give a transparent impression of the corner assembly according to the invention, the film can be implemented as a mirror on at least one surface or the coating can be adapted in color to the spacer profile.

In another advantageous improvement of the corner assembly according to the invention, an insulated glass element includes three panes. The three panes are spaced by an appropriate spacer profile and arranged parallel to each other. Such an insulated glass element is also referred to as a triple glazing.

Alternatively or additionally, the film can include fibers, in particular, glass fibers. These fibers serve for reinforcement and increase the stability of the film.

In another advantageous improvement, the film is transparent. In the context of the invention, a "transparent film" means that visible light substantially passes through the film.

In another particularly preferred improvement of the corner assembly according to the invention, the insulated glass elements are joined to each other using the film having the adhesive means. The adhesive means can have a silicon adhesive, in particular a transparent silicone adhesive, and/or an adhesive tape. For this, the silicone adhesive and/or adhesive tape is applied on the film and joined to the insulated glass elements on their abutment ends. The adhesive tape can be a transparent plastic film coated with adhesive on one or both sides. The thickness of the adhesive means can be from 8 mm to 50 mm.

In certain cases, it can be necessary for the adhesive means to have quick-stick properties on the order of a few seconds. The joining of the individual insulated glass elements can be particularly advantageously carried out at the final site of use. Because of the fact that the corner assembly is bonded only after reaching the site of use, the complexity of transport of the corner assembly is significantly reduced.

Preferably two abutting panes of the corner assembly protrude in each case beyond two other abutting panes at least in the abutment regions.

The insulated glass elements form an angle at which they butt against each other. The miter can correspond to a bisector of the angle with which the insulated glass elements are attached. The angle is preferably less than 180°, particularly preferably 90°.

Another aspect of the invention includes an insulated glass element for a corner assembly with at least two parallel arranged panes, which are in each case mitered on their end region and have a miter plane for contacting with a second insulated glass element. The panes are arranged offset relative to each other such that their miter planes lie in one plane and are joined to each other via a film.

Another aspect of the invention includes use of a corner assembly according to the invention in an all-glass façade.

In the following, the invention is explained in detail with reference to drawings and exemplary embodiments. The drawings are a schematic representation and are not true to scale. The drawings in no way restrict the invention.

Figure 2:
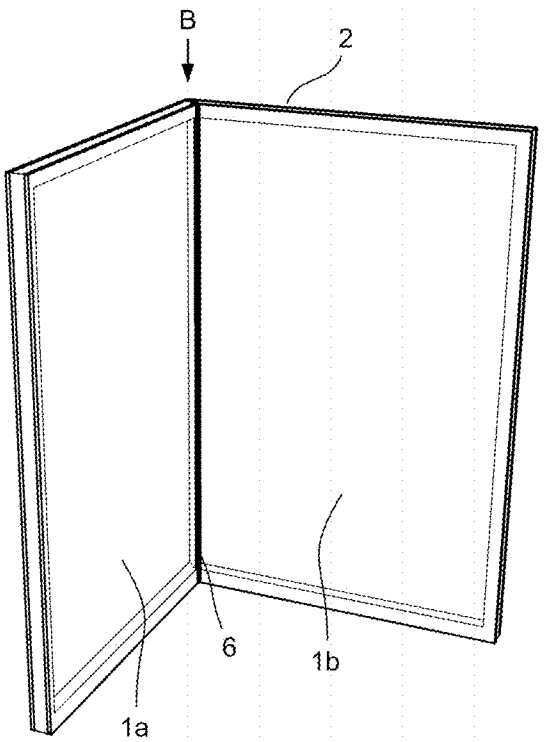
Figure 3:
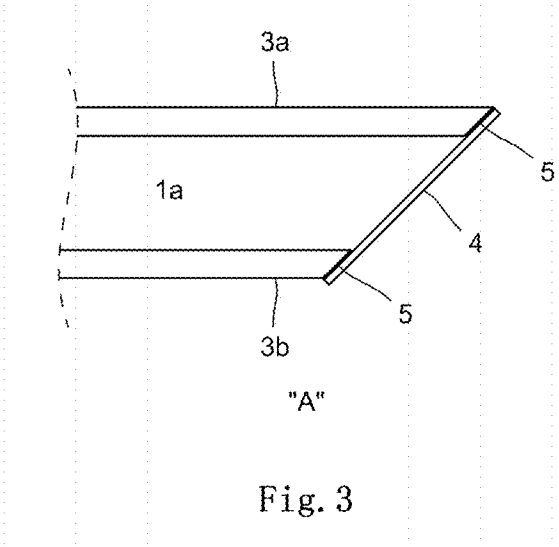
Figure 4:
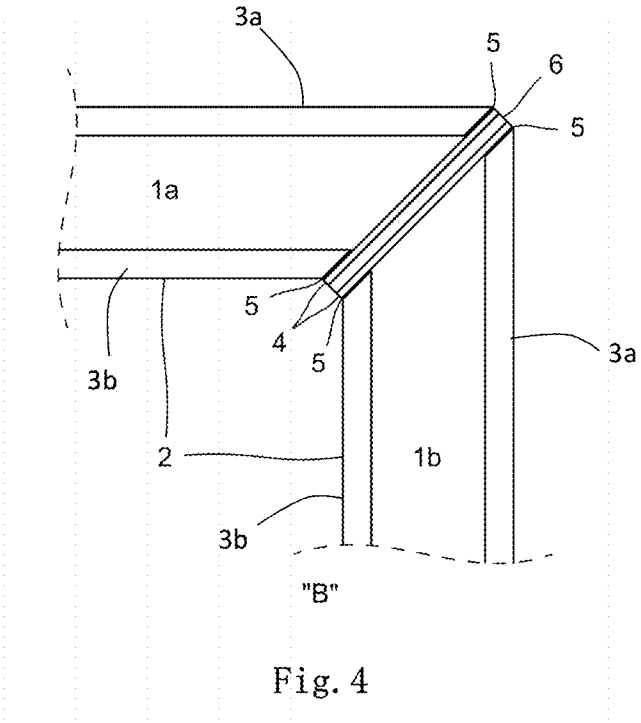

They depict:

FIG. 1 a perspective view of two insulated glass elements according to the invention, FIG. 2 a perspective view of a corner assembly of two insulated glass elements according to the invention, FIG. 3 a sectional view of an insulated glass element according to the invention, FIG. 4 a sectional view of the corner assembly of two insulated glass elements according to the invention.

FIG. 1 depicts a perspective view of the insulated glass elements 1*a*, 1*b* according to the invention. An insulated glass element includes two panes that are joined via a spacer profile. The spacer profile spaces, in the edge region, the parallel arranged panes at a constant distance from one another and is mounted peripherally on at least three sides of the panes. The spacer profile can consist, for example, of a simple hollow metal profile that is provided with a molecular sieve to dehumidify the interpane space formed between the panes. The panes are attached to the spacer profile using an adhesive such that the spacer profile substantially contributes to the mechanical strength of the insulated glass element 1*a*, 1*b*. Polyisobutylene is frequently used as an adhesive that simultaneously also has a sealing function for the insulated glass elements 1*a*, 1*b*.

Also, the insulated glass element 1*a*, 1*b* can include sealing means that are provided to seal the insulated glass element against moisture. Gas-tightness is also of significant importance for the insulated glass elements 1*a*, 1*b* especially when the interpane space is filled with a thermal insulating gas, e.g., argon.

The outwardly facing pane 3*a* in a building façade protrudes beyond the pane 3*b* facing the building such that the abutment region of the insulated glass elements 1*a*, 1*b*, is implemented like a miter. The miter can correspond to a bisector, e.g., 45°, of the angle at which the insulated glass elements are attached, e.g., 90°. In the region of their abutment ends, the panes are mitered. The pane 3*a* protrudes beyond the pane 3*b* only to the extent that the edges of the miter-shaped ends of the panes lie in a common plane.

The miter planes of the panes 3*a*, 3*b* have an acrylate adhesive. By means of the acrylate adhesive, a film 4 adheres in an edge-flush manner on the miter planes of the panes 3*a*, 3*b*. The film 4 joins the panes 3*a* and 3*b*. The width of the film 4 can correspond substantially to the width of the mitered abutment ends plus the width of the interpane space of an insulated glass element and is provided to hermetically seal the interpane space of the insulated glass element. The film 4 is made of polypropylene (e.g., PET) and can be reinforced in its load capacity by fibers. Moreover, it is possible for the film to be made of a mixture of materials such as plastic and metal.

The insulated glass elements 1*a* and 1*b* are structured virtually identically.

FIG. 2 depicts a perspective view of a corner assembly 2 according to the invention made of the two insulated glass elements 1*a* and 1*b*. The corner assembly 2 is made of the two insulated glass elements 1*a* and 1*b* abutting each other at an angle of 90°. On the abutment ends of the insulated glass elements 1*a*, 1*b*, the spacer profiles arranged between the panes 3*a*, 3*b* are form-fittingly bonded to one another using an adhesive.

FIG. 3 depicts a horizontal sectional view (A) of an insulated glass element 1*a* according to the invention. The insulated glass element 1*a* includes two panes 3*a* and 3*b*. The pane 3*a* can face outward on site and the pane 3*b* is positioned inward. The panes 3*a* and 3*b* are not mandatorily monolithic panes. The panes 3*a* and 3*b* can be implemented as insulating glass or composite glass or as a combination thereof. It is also possible to use combinations of glass and plastic panes.

The panes 3*a* and 3*b* can in each case have a thickness of 3 mm to 19 mm.

The outwardly oriented pane 3*a* protrudes beyond the building-side oriented pane 3*b* such that their miter planes lie in a common plane. The common plane can also be referred to as an extended common miter plane. The film 4 is arranged in the common miter plane. The film 4 adheres by means of the acrylate adhesive 5 to abutment ends of the panes 3*a* and 3*b*. The film 4 is implemented in an edge-flush manner on the insulated glass element 1*a*, in particular with the outer edges of the miter.

FIG. 4 is a horizontal sectional view (B) of the corner assembly 2 according to the invention assembled at the site of use. The corner assembly 2 consists of the two insulated glass elements 1*a* and 1*b* butting against each other at an angle of 90°. The corner assembly 2 represents only one possibility of the angle selection. The angle can vary to suit the site of use and have an angle size from 1° to 179°.

The two insulated glass elements 1*a* and 1*b* are in each case joined to each other at their films 4 using a transparent adhesive means 6. The adhesive means 6 is preferably a silicone adhesive. The insulated glass elements 1*a* and 1*b* butt against each other in the region of their abutment ends such that the interpane spaces of the panes 1*a* and 1*b* do not merge into a continuous interpane space filled with gas. Instead, the interpane spaces with their respective gas filling remain as two separate interpane spaces still separated by the film 4.

LIST OF REFERENCE CHARACTERS

1*a*, 1*b* insulated glass element
2 corner assembly
3*a*, 3*b* pane
4 film
5 acrylate adhesive
6 adhesive means

The invention claimed is:

1. A corner assembly, comprising:

two insulated glass elements abutting against each other at an angle, wherein each insulated glass element has at least two panes, the at least two panes arranged parallel to each other and joined to each other by a spacer profile, thus forming an interpane space between the at least two panes, and wherein the at least two panes have, on their end regions, mitered abutment ends, the mitered abutment ends being joined to each other via a film, the corner assembly further comprising a tape coated with adhesive on both sides, the tape joining the two insulated glass elements by adhesively attaching to an external side of the film of said each insulated glass element, the tape having a thickness of 8 mm to 50 mm.

2. The corner assembly according to claim 1, wherein the film is arranged on said each insulated glass element in an edge-flush manner.

3. The corner assembly according to claim 1, wherein the at least two panes are three panes.

4. The corner assembly according to claim 1, wherein the film adheres on the end region of the at least two panes by way of an adhesive.

5. The corner assembly according to claim 1, wherein the film has a coating.

6. The corner assembly according to claim 1, wherein the film comprises a plastic.

7. The corner assembly according claim 1, wherein the film is gas-tight and/or rigid.

8. The corner assembly according to claim 1, wherein the film is transparent and/or has a thickness of 0.001 mm to 3 mm.

9. The corner assembly according to claim 1, wherein the tape is a transparent tape.

10. The corner assembly according to claim 1, wherein the at least two panes of one of the insulating glass elements abutting against the at least two panes of the other insulating glass element, protrude beyond the at least two panes of the other insulating glass element, at least in regions where the at least two panes of one the insulating glass elements abut against the at least two panes of the other insulating glass element.

11. The corner assembly according to claim 1, wherein a miter, in the mitered abutment ends, corresponds to a bisector of an angle at which the two insulated glass elements are attached.

12. The corner assembly according to claim 4, wherein the adhesive is an acrylate adhesive.

13. The corner assembly according to claim 5, wherein the coating is an SiOx coating.

14. The corner assembly according to claim 6, wherein the plastic comprises polypropylene, and/or glass.

15. The corner assembly according to claim 1, wherein the tape comprises a silicone adhesive.

16. A glass façade comprising the corner assembly of claim 1.

* * * * *